US006467526B1

(12) United States Patent
Cope

(10) Patent No.: US 6,467,526 B1
(45) Date of Patent: Oct. 22, 2002

(54) METHOD OF MAKING A JEWELRY RING IN A VERTICAL MOLD

(75) Inventor: Steven Cope, Cincinnati, OH (US)

(73) Assignee: I.B. Goodman Manufacturing Co., Inc., Cincinnati, OH (US)

( * ) Notice: Subject to any disclaimer, the term of this patent is extended or adjusted under 35 U.S.C. 154(b) by 0 days.

(21) Appl. No.: 09/694,723

(22) Filed: Oct. 23, 2000

(51) Int. Cl.[7] ..... B22C 7/02; B22C 9/24; B22D 33/04

(52) U.S. Cl. ..... 164/35; 164/45; 164/137; 249/57

(58) Field of Search ..... 164/35, 45, 516, 164/137, 340, 342, 10, 11; 249/57

(56) References Cited

U.S. PATENT DOCUMENTS

| | | | | |
|---|---|---|---|---|
| 404,956 | A | 6/1889 | Burdon | 63/15 |
| 703,170 | A | 6/1902 | Baldt | 164/35 |
| 840,946 | A | 1/1907 | Levy | 63/15 |

(List continued on next page.)

FOREIGN PATENT DOCUMENTS

| | | |
|---|---|---|
| JP | 232002 | 9/1990 |

OTHER PUBLICATIONS

More than one year before the patent application was filed, it was known to use a horizontal mold with a multi–piece plug to manufacture an open back ring with a straight inner radius on the ring shank.

More than a year before the filing of the present invention, it was known in the art to use a vertical mold with a multi–piece plug to form a ring of solid construction, i.e, no hollow portion, with a rounded or beveled inside diameter.

More than a year before the filing of the present invention, it has also known in the art to manufacture a hollow jewelry ring using a lost–wax casting process. The hollow wax replica ring used for the lost–wax casting is formed by molding plastiwax around a water soluble wax core insert in a vertical metal mold. The vertical mold is closed around a cylindrical core or mandrel. The wax core insert is generally arcuate in shape and has a respective spacer pin extending radially inwardly from each end of the arcuate core insert. The arcuate extent of the arcuate core insert is substantially 130°. A sprue terminating with an alignment peg extended radially inwardly from a central part of the arcuate core insert. The cylindrical mandrel is formed of two pieces which are locked together t form the mandrel while defining a receptacle to accommodate the alignment peg of the wax core. After the wax replica is formed around the core insert, the core insert is dissolved to yield a hollow space within the replica. The hollow wax replica is then used for a conventional lost–wax (investment) casting step. The prior art ring has an inner (finger–facing) surface that was cylindrical. That is, the prior art ring has a 'flat' inner radius design.

*Primary Examiner*—M. Alexandra Elve
*Assistant Examiner*—Kevin P. Kerns
(74) *Attorney, Agent, or Firm*—Frost Brown Todd LLC

(57) ABSTRACT

A method of molding a jewelry ring having a beveled or rounded inner diameter and a hollow portion in a vertical mold comprises utilizing a multi-piece plug and a soluble insert in a mold to define a mold cavity in the desired shape of the ring or a portion of the ring. A molten material is introduced into the mold cavity and upon hardening forms a ring replica which is removed from the mold by first removing the formed ring replica from the mold halves and then removing the ring replica from the multi-piece plug by separating the multi-piece plug into its individual pieces. The ring replica can be used to form jewelry rings by investment casting.

12 Claims, 8 Drawing Sheets

U.S. PATENT DOCUMENTS

| | | | | | |
|---|---|---|---|---|---|
| 1,050,370 | A | | 1/1913 | McGlashan et al. | 164/11 |
| 1,285,882 | A | | 11/1918 | Zielinski | 63/1.13 |
| 1,365,672 | A | | 1/1921 | Fawcett | 164/11 |
| 1,365,702 | A | | 1/1921 | Knadler | 164/11 |
| 1,398,706 | A | | 11/1921 | Rust | 164/11 |
| 2,078,562 | A | | 4/1937 | Cohen | 164/15 |
| 2,103,413 | A | | 12/1937 | Gaertner | 29/896.412 |
| 3,302,257 | A | * | 2/1967 | Kaplan | 164/34 |
| 3,401,738 | A | | 9/1968 | Parille | 164/353 |
| 3,511,466 | A | | 5/1970 | Kaplan | 249/57 |
| 3,554,875 | A | | 1/1971 | MacKinney | 205/73 |
| 3,561,521 | A | | 2/1971 | Reneer | 164/45 |
| 3,562,900 | A | | 2/1971 | Buehler | 29/527.6 |
| 3,838,728 | A | | 10/1974 | Voegele | 164/45 |
| 3,991,809 | A | | 11/1976 | Voegele | 164/35 |
| 4,392,289 | A | | 7/1983 | Michaud | 29/896.41 |
| 4,530,740 | A | | 7/1985 | Wolf et al. | 205/73 |
| 4,630,346 | A | | 12/1986 | Singer | 29/896.41 |
| 4,681,664 | A | | 7/1987 | Eberle et al. | 63/34 |
| 4,710,276 | A | | 12/1987 | Kull | 29/10 |
| 4,722,770 | A | | 2/1988 | Blottiere et al. | 205/73 |
| 4,761,206 | A | | 8/1988 | Forrest | 205/50 |
| 4,811,778 | A | | 3/1989 | Allen et al. | 164/516 |
| 5,172,568 | A | | 12/1992 | Senanayake | 63/33 |
| 5,393,405 | A | | 2/1995 | Iacono et al. | 205/72 |
| 5,606,873 | A | | 3/1997 | Zeller et al. | 63/15 |
| 5,718,278 | A | * | 2/1998 | Baum | 164/35 |
| 5,916,271 | A | | 6/1999 | Baum | 63/15 |
| 5,979,537 | A | | 11/1999 | Baum | 164/235 |
| 6,032,719 | A | | 3/2000 | Baum | 164/35 |

* cited by examiner

METHOD OF MAKING A JEWELRY RING IN A VERTICAL MOLD

FIELD OF THE INVENTION

The present invention relates to a method of producing a jewelry ring or a portion of a jewelry ring. More particularly, the present invention relates to a method of molding a jewelry ring or a portion of a jewelry ring with a hollow portion and a beveled or rounded inner diameter on the shank of the ring.

BACKGROUND INFORMATION

In the art of jewelry making, various manufacturing processes are utilized to produce mass quantities of metallic jewelry articles in intricate detail: electroforming, die striking, and casting, for example. These processes facilitate high volume production at relatively low production cost. However, jewelry makers continue to seek innovative methods that reduce production costs even further while maintaining the ability to produce high quality articles with sufficient detail and comfort for the wearer.

Because jewelry making is an industry that relies heavily on precious metals, raw materials constitute a significant portion of the production costs. Methods that maximize the efficiency of materials usage in production are highly valued. It is well known in the art that producing jewelry articles of hollow or partially hollow construction may minimize such costs. In addition, processes that reduce the need to grind away material, such as seam lines that result from molding, minimize excess use of materials and time.

In addition to being mindful of the high production costs in jewelry making, jewelry ring makers recognize the importance of comfort in their designs. To achieve a more comfortable design, the prior art teaches methods by which jewelry rings can be manufactured with a shank that is beveled or rounded on the inside diameter of the shank i.e., that portion of the shank that contacts the finger. The shank of a ring is defined as the portion of the ring that encircles the finger. A beveled or rounded inside diameter provides improved comfort in the wearing, placement, and removal of the ring. In the art of jewelry ring making, prior to the present invention, there had been distinct lack of knowledge as to how to manufacture jewelry rings with a hollow portion and a beveled or rounded inside diameter on the shank in a vertical mold.

As shown in U.S. Pat. No. 3,838,728, "Method for Molding Finger Rings," issued to Voegele on Oct. 1, 1974, and U.S. Pat. No. 3,511,466, "Mold for Wax Patterns for Casting Finger Rings," issued on May 12, 1970 to Kaplan, conventional vertical molds used to mold ring replicas utilize upper and lower mold halves and a one-piece cylindrical plug to form a mold cavity in the shape of a ring. The upper and lower mold halves form the upper and lower halves of the circumference of the ring, respectively and hold the cylindrical plug in place to form a mold cavity. Once formed in the mold cavity, the ring replica and cylindrical plug are removed from the mold halves. The ring replica, having an inner diameter of the shank that is "flat," is subsequently slidably removed from the cylindrical plug. Such vertical molds with the cylindrical plug are not capable of forming a ring with a beveled or rounded inner diameter on the shank.

One method of producing jewelry rings with an inner round radius design on the shank is disclosed in U.S. Pat. No. 6,032,719, "Method for Producing Hollow Jewelry Ring," issued to Baum on Mar. 7, 2000; U.S. Pat. No. 5,916,271, "Hollow Jewelry Ring Having Inner Round Design," issued to Baum on Jun. 29, 1999; U.S. Pat. No. 5,718,278, "Method for Producing Hollow Ring Having Inner Round Radius Design," issued to Baum on Feb. 17, 1998; and U.S. Pat. No. 5,979,537, "Wax Replica and Soluble Core Insert Used for Producing Hollow Jewelry Ring," issued to Baum on Nov. 9, 1999. These four patents disclose a horizontal two-part mold used to form a plastiwax replica of a ring. A horizontal two-part mold is oriented with the lower die and the upper die arranged to define a cavity having the circular shape of the ring; each die is formed with a cavity defining substantially one-half the ring shape in an axial direction. Investment casting is subsequently used to convert the plastiwax replica into a metal ring. A horizontally oriented mold configuration is utilized in this method because, according to the four Baum patents, "using the conventional techniques and the vertically oriented mold configuration, it is impossible to produce a ring having an inner round radius design." See, e.g., U.S. Pat. No. 5,916,271 Col. 5, Lines 5–10.

The use of a horizontal mold has drawbacks. Due to the imperfect mating characteristics and shrinkage of the hardened material, a mold seam is inevitable in molds using two or more parts for defining an inner cavity. In utilizing a horizontal mold to achieve a beveled or rounded inside diameter on the shank, a seam will be produced along the entire inner and outer circumference of the ring. Removal of such a lengthy seam involves excess time and loss of excess material. Furthermore, horizontal molds cannot be used to produce rings with certain design features. In contrast, the present invention provides for a shorter seam line at only two places around the circumference of the ring.

It is known in the art to use a vertical mold with a multi-piece plug to form a ring of solid construction, i.e., no hollow portion, with a rounded or beveled inside diameter.

It is also known in the art to manufacture a hollow jewelry ring using a lost-wax casting process. The hollow wax replica ring used for the lost-wax casting is formed by molding plastiwax around a water soluble wax core insert in a vertical metal mold. The vertical mold is closed around a cylindrical core or mandrel. The wax core insert is generally arcuate in shape and has a respective spacer pin extending radially inwardly from each end of the arcuate core insert. The arcuate extent of the arcuate core insert is substantially 130°. A sprue terminating with an alignment peg extended radially inwardly from a central part of the arcuate core insert. The cylindrical mandrel is formed of two pieces which are locked together to form the mandrel while defining a receptacle to accommodate the alignment peg of the wax core. After the wax replica is formed around the core insert, the core insert is dissolved to yield a hollow space within the replica. The hollow wax replica is then used for a conventional lost-wax (investment) casting step. The prior art ring has an inner (finger-facing) surface that was cylindrical. That is, the prior art ring has a 'flat' inner radius design.

However, previously there has been no method of producing a ring with a hollow portion made using a soluble insert and a rounded or beveled inside diameter on the shank made using a multi-piece plug in a vertical mold.

SUMMARY OF THE INVENTION

The invention provides a method of producing a jewelry ring with a hollow portion comprising the steps of providing a vertical mold comprising an upper mold half and lower mold half; providing a multi-piece plug comprising at least a first piece and a second piece; providing a soluble insert; positioning said soluble insert and said multi-piece plug within said vertical mold so as to form a mold cavity; introducing molten material into said mold cavity; cooling said molten material to form a ring replica; separating the upper mold half and lower mold half; removing the multi-piece plug with said ring replica formed around it from within the upper mold half or lower mold half; separating said first piece of said multi-piece plug from said second piece and thereby releasing said ring replica from said multi-piece plug; dissolving the insert from said ring replica; casting a jewelry ring using said ring replica in an investment casting process.

The invention further provides a method of producing a ring replica comprising the steps of providing a vertical mold comprising an upper mold half and a lower mold half; providing a multi-piece plug comprising at least a first piece and a second piece; providing a soluble insert; positioning said soluble insert and said multi-piece plug within said vertical mold so as to form a mold cavity; introducing molten material into said mold cavity; cooling said molten material to form a ring replica; separating the upper mold half from the lower mold half; removing said multi-piece plug with said ring replica formed around it from the upper mold half or lower mold half, and separating said first piece of said multi-piece plug from said second piece thereby releasing said ring replica from said multi-piece plug.

BRIEF DESCRIPTION OF DRAWINGS

The following description of preferred embodiments of the invention may be better understood when read in conjunction with the appended drawings. It should be understood, however, that the invention is not limited to the precise arrangements demonstrated, in which.

DETAILED DESCRIPTION OF THE PREFERRED EMBODIMENTS

While the inventive method described hereinafter pertains to the production of a metal jewelry ring, it will be apparent to those of ordinary skill in the art that the inventive method may be applied to produce a variety of articles and designs, using an array of manufacturing techniques and materials. The preferred method for achieving the inventive method is described as such for illustrative purposes only.

As defined and understood herein, a jewelry ring is capable of existing in a variety of forms and being used in numerous applications. A jewelry ring is generally circular and may be accompanied and attached with additional pieces, such as settings and/or precious stones. A jewelry ring is typically worn on a finger but given contemporary and evolving applications of jewelry rings, as defined herein, it can also be worn as a toe ring or used as an attachment to an ear or nose.

Figure 11:
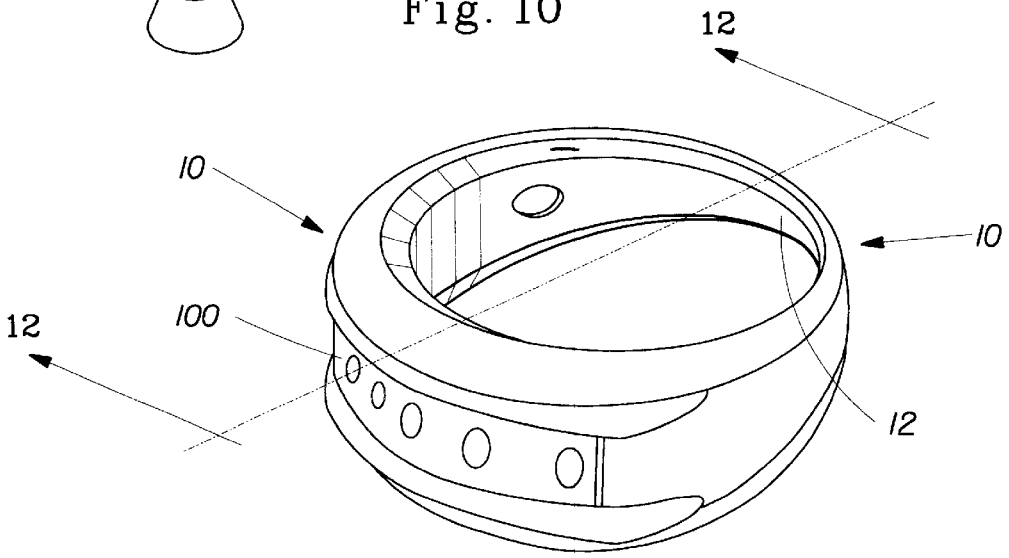
FIG. 11 is a perspective view of a metal ring with an attached metal setting.
Figure 12:
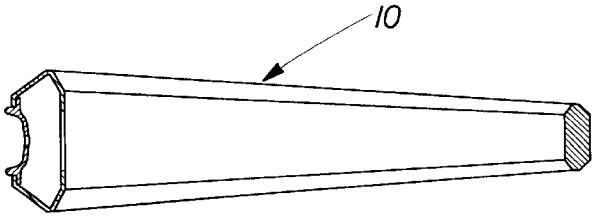
FIG. 12 is a cross-sectional view of the ring shown in FIG. 11, taken along line 12—12.

Contrary to the teachings of prior art, in the present invention a vertical mold is utilized to produce a jewelry ring 10 having a hollow portion and a beveled or rounded inner diameter on the shank 12 such as that shown in FIG. 11 and FIG. 12, wherein the inner diameter of the ring is of varying dimensions. Typically, as shown in FIG. 12, if observed from a cross-sectional view, the interior shape of a ring having such design is obtusely angled or generally parabolic.

To produce a ring replica having a beveled or rounded inner diameter on the shank, a vertically oriented mold configuration is utilized. As shown in FIGS. 1A–C, and 5 the ring mold 20 is oriented with the lower mold half 22, upper mold half 24, and a multi-piece plug 50 arranged to define a mold cavity 28 having the shape of the desired ring replica. Each mold half 22 and 24, in conjunction with the multi-piece plug 50, forms a mold cavity 28 defining substantially one-half the ring replica 40 in the radial direction, illustrated by a dashed line in FIG. 11.

Figure 1A:
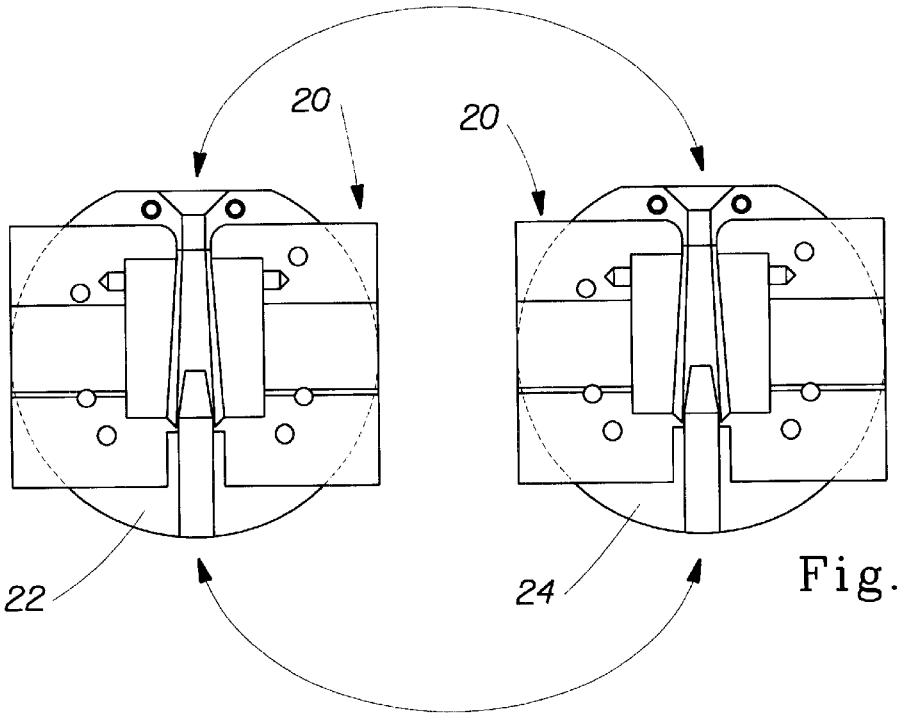
FIG. 1*a* is a plan view of the two halves of a vertical mold.
Figure 1B:
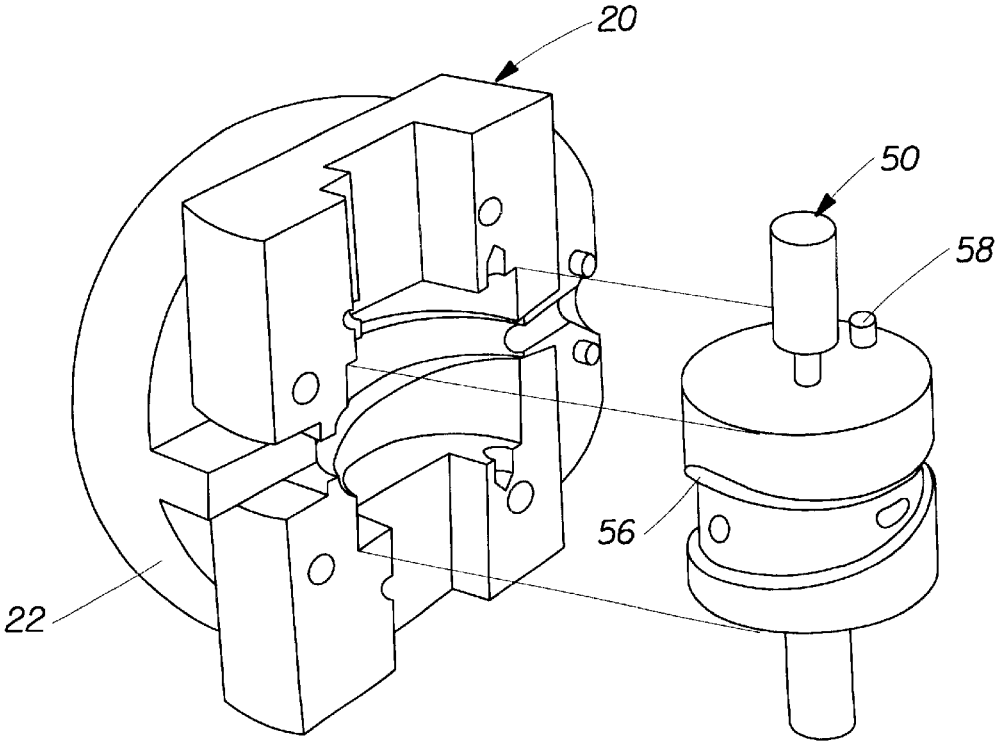
FIG. 1*b* is a perspective exploded view of the half of the vertical mold with a multi-piece plug.
Figure 1C:
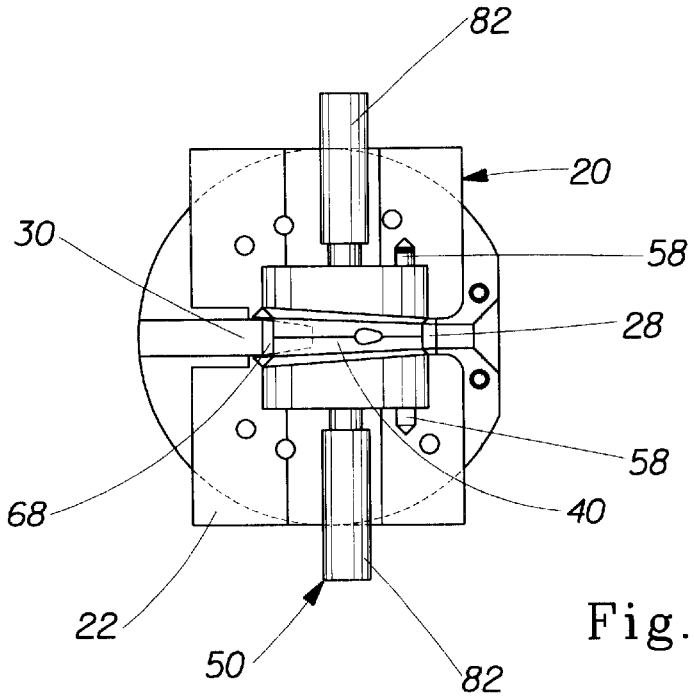
FIG. 1*c* is another perspective exploded view of the half of the vertical mold with a multi-piece plug.
Figure 2A:
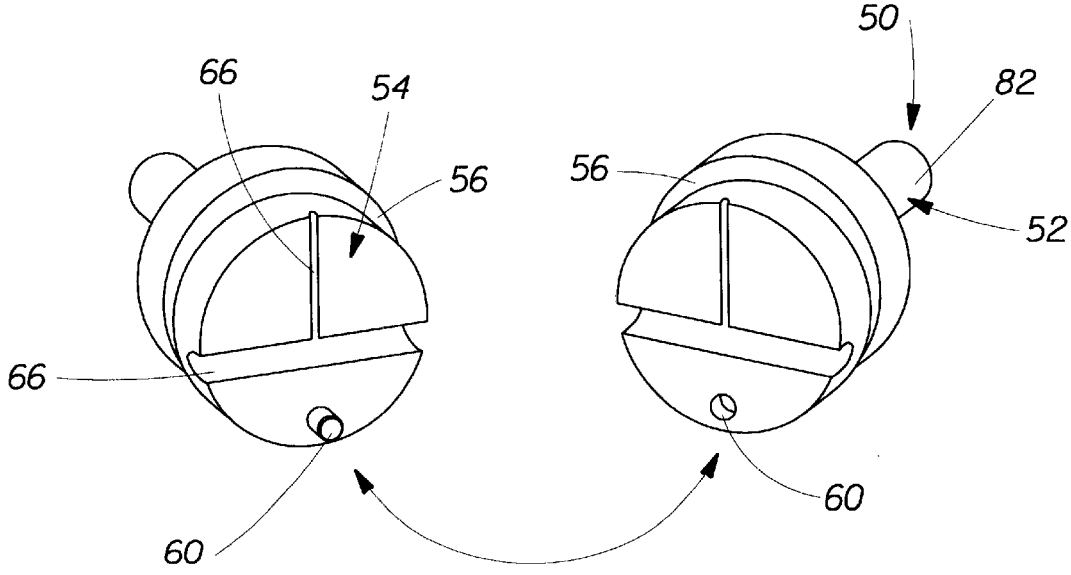
FIG. 2*a* is a perspective view of the multi-piece plug.
Figure 2B:
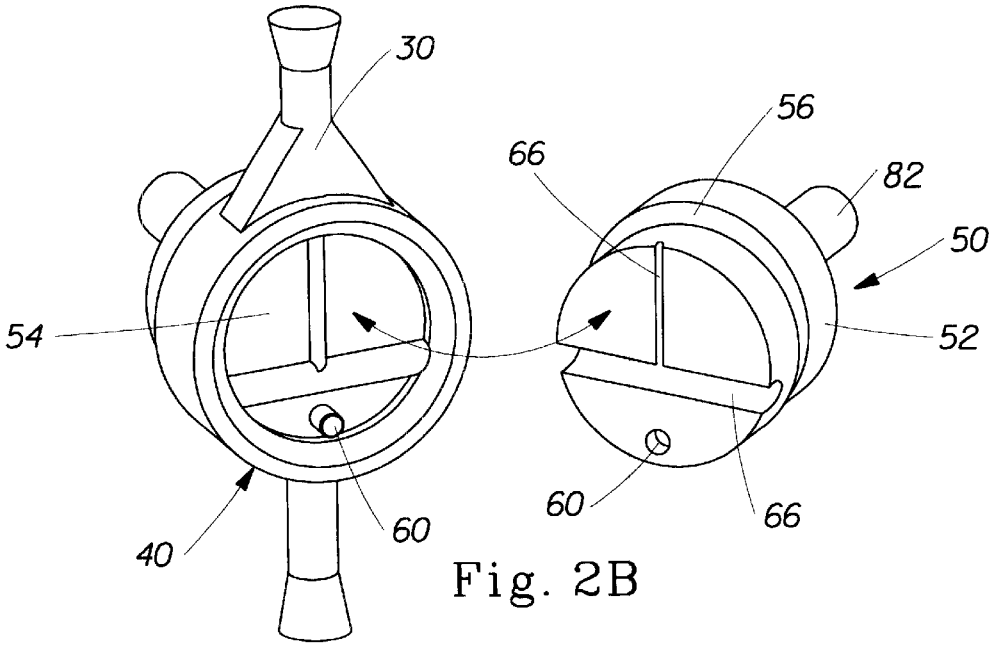
FIG. 2*b* is a perspective view of the multi-piece plug with a soluble insert and a ring replica.
Figure 2C:
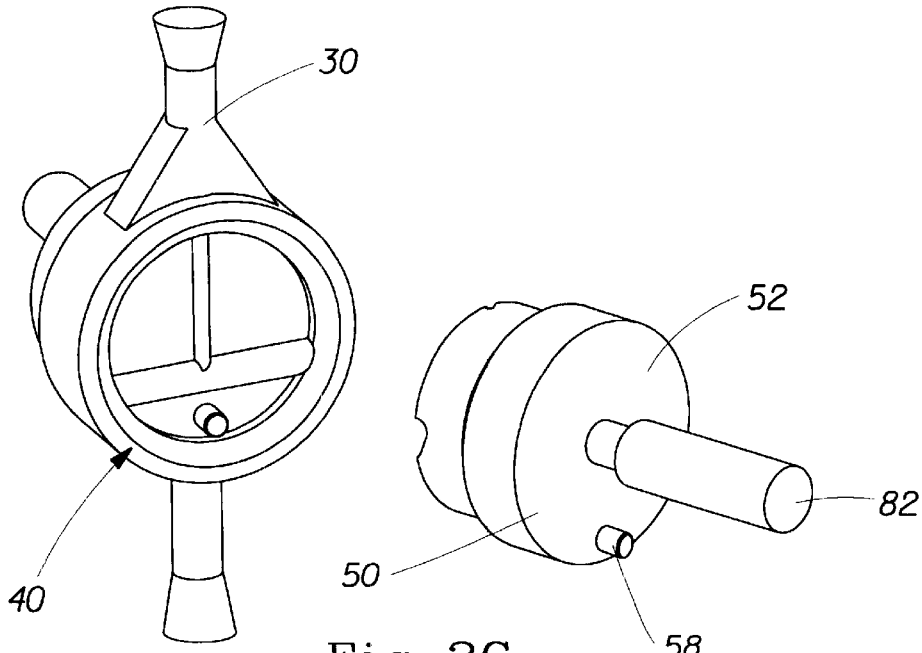
FIG. 2*c* is another perspective view of the multi-piece plug with the soluble insert and the ring replica.

As shown in FIGS. 2A–C, the plug 50 is a multi-piece plug consisting of at least two pieces 52, 54. Prior to being placed within the mold halves, 22, 24, or upon being placed within the mold halves 22, 24, the at least two pieces 52, 54 are connected together to form a substantially continuous plug 50, but the at least two pieces 52, 54 remain separable. A portion 56 of the multi-piece plug is inwardly angled or curved, i.e., it has a varying outer diameter or cross-sectional area so as to form the beveled or rounded inner diameter on the shank 12 of the ring. The multi-piece plug 50 preferably includes at least one locator pin 58 that locates the plug 50 in one of the mold halves 22, 24, of the vertical mold 20. Similarly, at least one piece 52 or 54 of the multi-piece plug 50 includes at least one locking means 60 that holds at least the first piece 52 and the second piece 54 of the multi-piece plug 50 together in the proper orientation. It is believed that this locking means 60 relieves stress on the soluble insert 30 preventing cracking of the soluble insert 30 during the introduction of the molten material into the mold cavity 28.

The mold halves 22, 24, and the multi-piece plug 50 may be produced by a variety of methods. For example, conventional tooling may be utilized to shape the mold halves 22, 24, and multi-piece plug 50 to form the desired mold cavity 28. Other methods include casting, hand machining, and the use of resins which can be molded to the desired shape. Each of the mold halves 22, 24, and the multi-piece plug 50 can be made by the same method or each part can be made by a different method. As will be appreciated by those of ordinary skill in the art, the desired shape and size of the mold halves 22, 24 and multi-piece plug 50 should allow for shrinkage of a molten material, such as wax or plastic, as it solidifies within the mold cavity 28. Furthermore, the mold halves 22, 24 and multi-piece plug 50 should be constructed of material capable of containing molten material such as wax or plastic without deformation, and of forming said molten material in sufficient detail to produce the desired ring design. The mold halves 22, 24 and multi-piece plug 50 may therefore be formed of brass, other metals, resins, or any materials capable of withstanding the temperature, thermal stresses, and pressure associated with the ring replica molding process. In addition, such material should have adequate heat transfer capabilities for proper and rapid cooling of the molten material. In one embodiment, the mold halves have sufficient strength that they require no additional support, such as a mold box, to withstand the molding pressures.

The ring mold 20 is used in conjunction with a soluble insert 30 to produce a ring replica 40 of a hollow or partially hollow construction.

Figure 4:
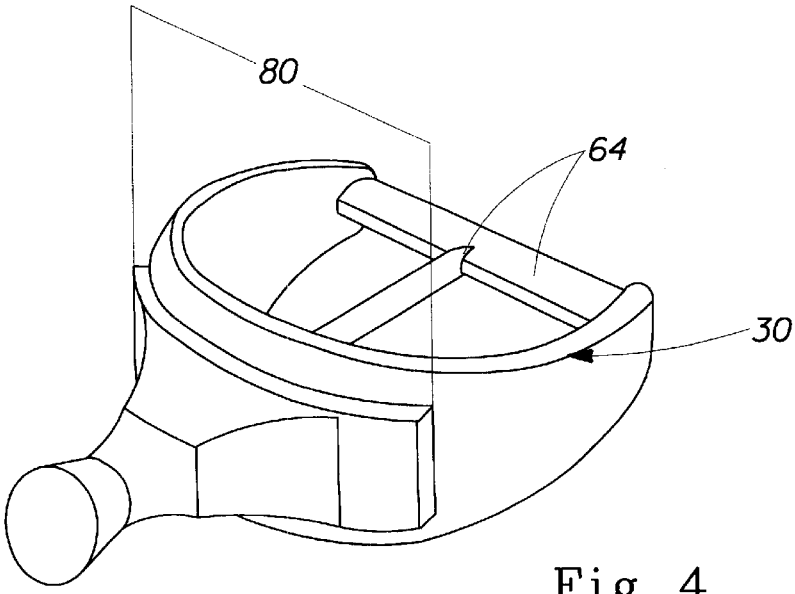
FIG. 4 is a perspective view of the soluble insert.
Figure 5:
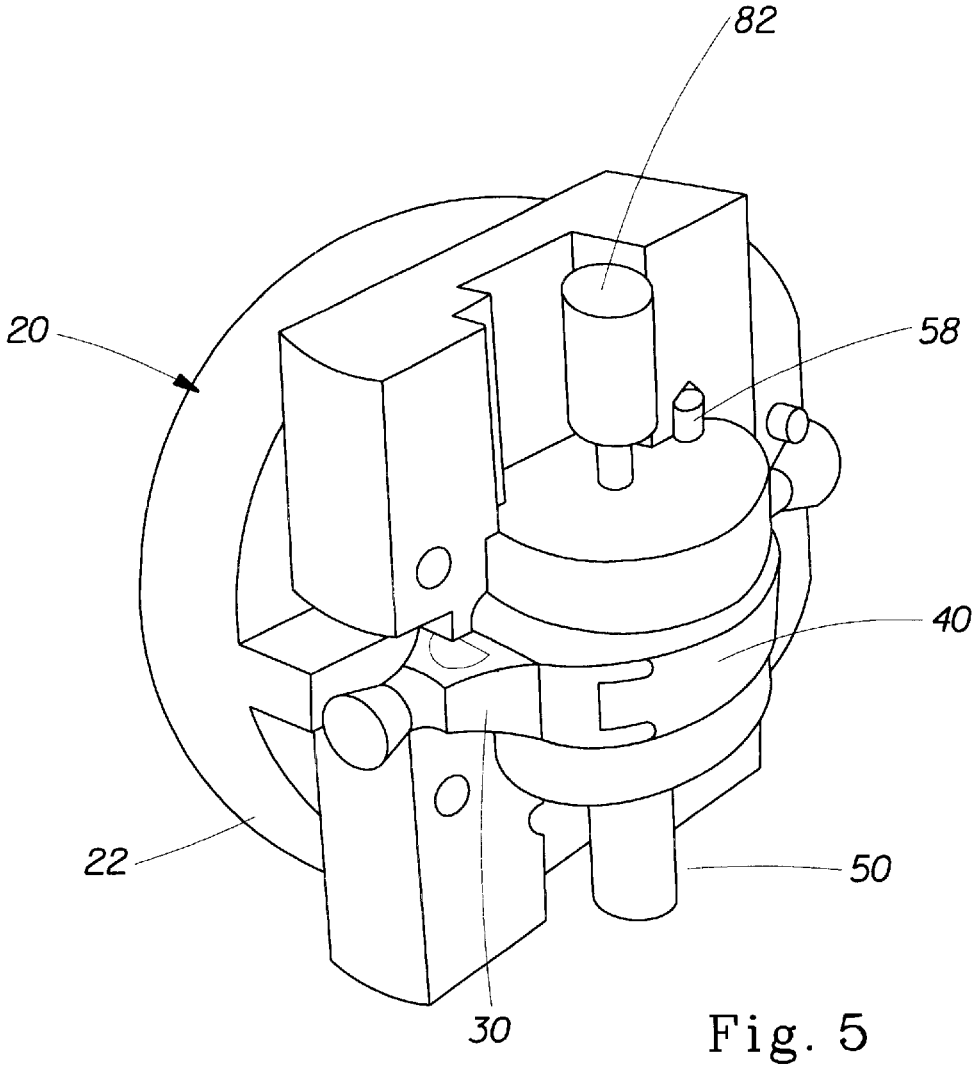
FIG. 5 is a perspective view of the one half of the vertical mold, the multi-piece plug and the soluble insert as assembled.

A soluble insert 30 is an insert made of a material that is soluble in one or more solvents. For example, water soluble waxes are well known and used in the industry. Ceramics soluble in acidic solutions are well known and used in the jewelry industry. In making a ring replica 40 with a hollow or partially hollow construction, a soluble insert 30, such as that shown in FIG. 4, is positioned within mold half 22 or 24, prior to introduction of the molten material. See FIG. 5. The soluble insert 30 may be positioned anywhere within the mold cavity and may be secured by alignment means, such as alignment bars 64 which correspond with grooves 66 formed within the multi-piece plug 50. The soluble insert 30 may be positioned by other methods known in the art such as pegs or stops. Such alignment means serve to maintain the position and stability of the soluble insert 30 during injection of the molten material into the mold cavity 28. In addition, they provide for better airflow within the mold 20, reducing flashing problems that may occur during formation of the ring replica 40. Typically, such soluble insert 30 is positioned within the crown portion 68 of the mold cavity 28.

Figure 3:
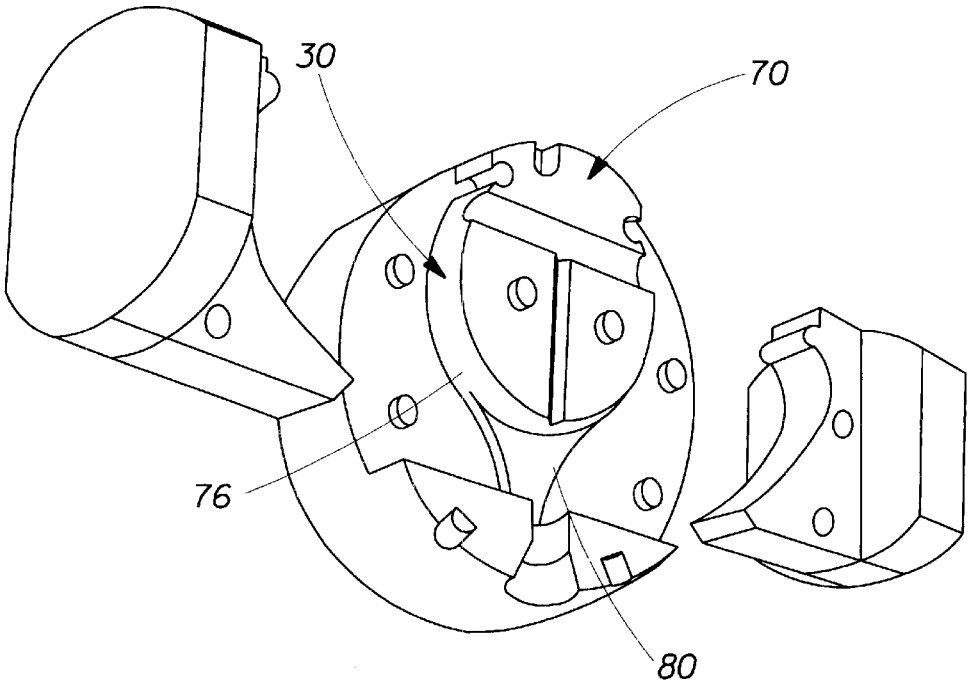
FIG. 3 is a perspective view of the insert mold.

The soluble insert 30 may be produced by utilizing an insert mold 70, as shown in FIG. 3. Such an insert mold 70 comprises at least an upper and lower mold half formed with a cavity 76 in the shape of the desired soluble insert 30. The insert mold 70 can be formed so as to form alignment means, for example, at least one alignment bar 64. The alignment bar 64 may be configured so that the soluble insert 30 can be held in position by the multi-piece plug 50. The alignment bar 64 also provides a means to collect any gases trapped within the insert mold 70, thereby ensuring proper filling of the soluble insert 30 without air pockets.

Typically, the soluble insert 30 will be of a shape generally similar to that of the crown portion 68 of the ring, but slightly reduced in size so as to allow molten material to flow around the shape of the soluble insert 30 to form the outer wall of the ring 10. Preferably, there is an offset of approximately 0.021 to 0.030 inches between the soluble insert 30 and the inner wall of the mold cavity 28 to form jewelry rings of suitable wall-thickness and strength. Methods of producing soluble inserts 30 are known in the art. For example, see Japanese Laid Open Patent Application 2-232002, filed Mar. 7, 1989 which is incorporated herein by reference. It is conceivable that other processes, such as machining, may be used to produce the soluble insert 30.

In another embodiment, the soluble insert 30 can be formed so as to include a top cap 80. The top cap 80 allows the top of the crown portion 68 of the ring replica 40 to be formed within the vertical mold 20, without the use of an additional die insert. In this way, one vertical mold 20 can be used to form more than one ring replica design. The top cap 80 is shaped to include the features desired in the crown portion 68 of the ring replica 40. When the molten material is introduced into the mold cavity, it flows around the top cap 80, giving the desired shape to the ring replica 40.

Molten material is introduced into the mold cavity 28. Equipment suitable for adequately melting such molten material prior to introduction into the mold cavity 28 is well known and commercially available. Furthermore, introduction of said molten material into the mold cavity 28 should be conducted in a manner which facilitates the escape of all excess air or gases from within the mold cavity 28. Such methods are well known to those of ordinary skill in the art. For example, a "wax pot" subject to adequate pressure and heat may be used to melt and inject the molten material into the mold cavity 28.

Once the molten material has sufficiently cooled and/or hardened, the ring replica 40 is removed from the return mold 20. As shown in FIGS. 2A–C, to facilitate such removal, the multi-piece plug 50, can be equipped with handles 82. The handles 82 allow the ring replica 40 and the multi-piece plug 50 to be removed from the mold halves 22, 24 more easily and without damaging the ring replica 40.

Having a beveled or rounded inner diameter on the shank, it is not possible to "slidably" remove the ring replica 40 from the multi-piece plug 50 as it exists in its entirety. To remove the ring replica 40 from the multi-piece plug 50, the first piece of the plug 52 is separated from the second piece 54, releasing the ring replica 40 from the multi-piece plug 50 completely. In a separate embodiment, the multi-piece plug 50 may consist of more than two pieces. In such case, the plug would be similarly separated into its individual pieces to release the ring replica.

Figure 6:
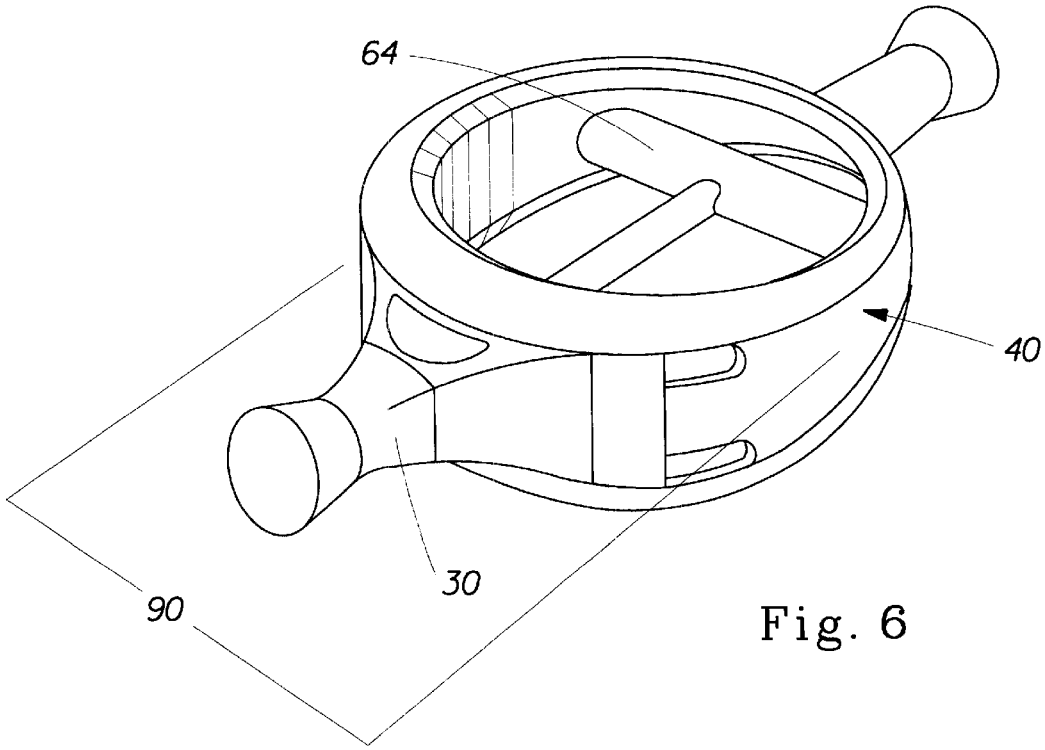
FIG. 6 is a perspective view of a ring replica with the soluble insert.
Figure 7:
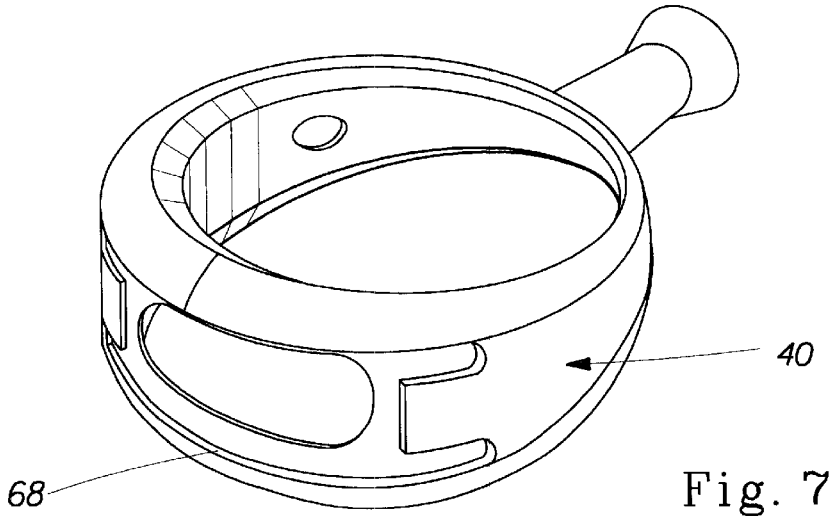
FIG. 7 is a perspective view of the ring replica after removal of the soluble insert.
Figure 8:
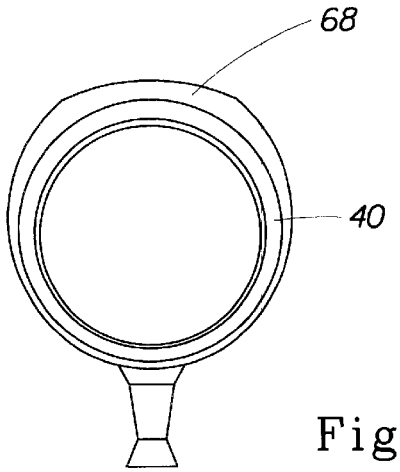
FIG. 8 is a plan view of the ring replica.

As shown in FIG. 6, the ring replica 40 after removal from the multi-piece plug 50 contains the soluble insert defining the desired hollow portion of the ring body. The soluble insert 30, being soluble, is then removed from the ring replica 40 by exposure of the ring replica 40 to the proper solution, in a manner well known in the art, resulting in a ring replica 40 of a hollow or partially hollow construction. See FIG. 7. The hollow portion 90 can have an arcuate length greater than 180°. The hollow portion 90 extends from one side of the alignment bar 64 to the other side. See FIG. 6.

The ring replica 40 made by the process of the present invention can be used to produce a metal ring by the lost wax casting method which is well known in the art. In such a method, ring replicas 40 are placed on a wax pole to form a "tree," which is subsequently encased in a cylinder of investment material. Plaster-of-Paris, containing gypsum and silica, is typically used as the investment material. Investment materials are well-known in the art and any suitable investment material may be used with the ring replica of the present invention. During the investment process, the investment material may be placed under a vacuum to remove air from the material. The cylinder of investment material is subsequently dewaxed i.e., the ring replica is melted and/or baked out of the investment material. The baked investment material then defines an investment mold cavity in the shape of the original wax tree. By introducing molten metal, such as gold, platinum, or any desired metal into the investment mold cavity, a metal tree is formed. The investment material may be removed from the tree by various means, such as pressurized water removal. The cast metal rings or ring portions formed are removed from the tree, for example by clipping. The metal rings may then be polished and finished.

Figure 9A:
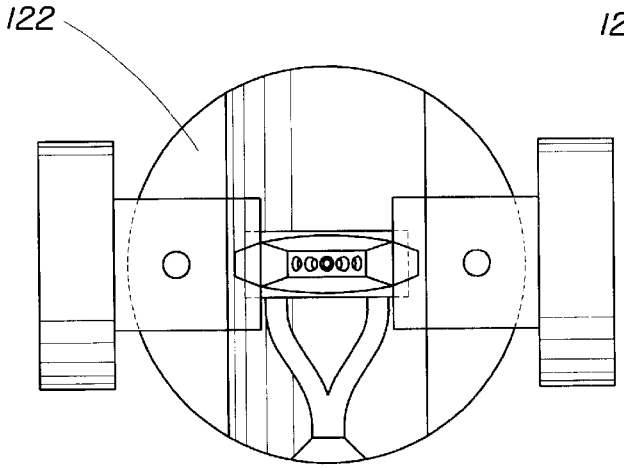
FIGS. 9A and 9B are perspective views of the facing mold half and backing old half used to form the setting.
Figure 9B:
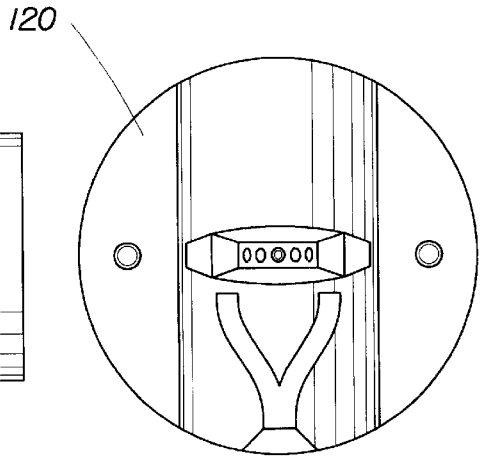
Figure 10:
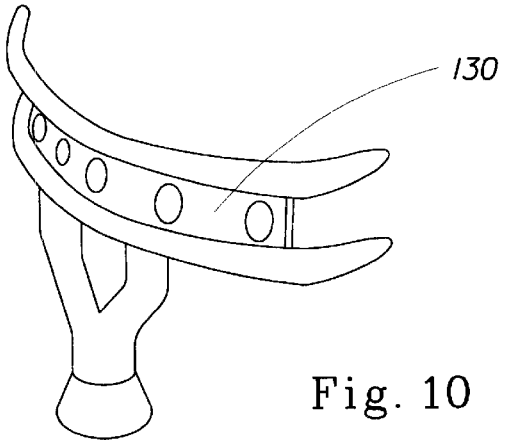
FIG. 10 is a perspective view of the setting.

A metal setting 100 may be attached to the finished metal ring 10. Such a setting 100 is shown in FIG. 11 and is formed by utilizing backing and facing mold halves 120, 122 such as that shown in FIG. 9. In a manner similar to forming a ring replica 40, a setting replica 130 is formed within the backing and facing mold halves 120, 122. Such a setting replica 130 is generally formed of plastiwax, although any suitable wax or plastic known in art the can be used. Subsequently, metal settings are formed in a lost wax investment casting process similar to that described above for making metal rings or ring portions.

In a separate embodiment, the multi-piece plug 50 may consist of more than two pieces. In such case, the multi-piece plug 50 would be separated into its individual pieces to release the ring replica 40.

While the inventive method presented has been described with respect to specific embodiments, it should be well recognized that such method includes any and all changes and modifications thereto which would be apparent to those skilled in the art and which come within the spirit and scope of the appended claims.

What is claimed is:

1. A method of producing a jewelry ring with a shank and a hollow portion comprising the steps of:

providing a vertical mold comprising an upper mold half and lower mold half;

providing a multi-piece plug comprising at least a first piece and a second piece to form a ring with a beveled or rounded interior design on the shank, wherein the multi-piece plug has at least two outer diameters;

providing a soluble insert;

positioning said soluble insert and said multi-piece plug within said vertical mold so as to form a mold cavity;

introducing molten material into said mold cavity;

cooling said molten material to form a ring replica;

separating the upper mold half and lower mold half;

removing the multi-piece plug with said ring replica formed around it from within the upper mold half or lower mold half;

separating said first piece of said multi-piece plug from said second piece, thereby releasing said ring replica from said multi-piece plug;

dissolving the insert from said ring replica; and casting a jewelry ring using said ring replica in an investment casting process.

2. A method according to claim 1, wherein said multi-piece plug comprises at least three pieces.

3. A method according to claim 1, wherein said soluble insert is formed of water soluble wax.

4. A method according to claim 1, wherein said soluble insert is formed with alignment means.

5. A method according to claim 4, wherein the alignment means comprises at least one alignment bar.

6. A method according to claim 1, wherein said soluble insert is formed with a top cap.

7. A method of producing a ring replica comprising the steps of:

providing a vertical mold comprising an upper mold half and a lower mold half;

providing a multi-piece plug comprising at least a first piece and a second piece to form a ring with a shank and having a beveled or rounded interior design on the shank, wherein the multi-piece plug has at least two outer diameters;

providing a soluble insert;

positioning said soluble insert and said multi-piece plug within said vertical mold so as to form a mold cavity;

introducing molten material into said mold cavity;

cooling said molten material to form a ring replica;

separating the upper mold half from the lower mold half;

removing said multi-piece plug with said ring replica formed around it from the upper mold half or lower mold half; and separating said first piece of said multi-piece plug from said second piece thereby releasing said ring replica from said multi-piece plug.

8. A method according to claims 7, wherein said multi-piece plug comprises at least three pieces.

9. A method according to claim 7, wherein said soluble insert is formed of water soluble wax.

10. A method according to claim 7, wherein said soluble insert is formed with alignment means.

11. A method according to claim 10, wherein the alignment means comprises at least one alignment bar.

12. A method according to claim 7, wherein said soluble insert is formed with a top cap.

* * * * *